US009526336B2

(12) United States Patent
Wells et al.

(10) Patent No.: US 9,526,336 B2
(45) Date of Patent: Dec. 27, 2016

(54) STORAGE SYSTEM

(71) Applicant: MasterBrand Cabinets, Inc., Jasper, IN (US)

(72) Inventors: Andrew D. Wells, Nashville, TN (US); Steven J. Park, Floyd's Knobs, IN (US); Tanner K. Horton, Vincennes, IN (US); Kimbra Gunselman, Jasper, IN (US); Tammy Hess, Leopold, IN (US); Bryan Barnes, Macon, IL (US); Daniel K. Buck, Jasper, IN (US)

(73) Assignee: MasterBrand Cabinets, Inc., Jasper, IN (US)

( * ) Notice: Subject to any disclaimer, the term of this patent is extended or adjusted under 35 U.S.C. 154(b) by 0 days.

(21) Appl. No.: 14/732,890

(22) Filed: Jun. 8, 2015

(65) Prior Publication Data

US 2015/0351538 A1 Dec. 10, 2015

Related U.S. Application Data

(60) Provisional application No. 62/009,628, filed on Jun. 9, 2014.

(51) Int. Cl.

| | |
|---|---|
| ***A47B 95/00*** | (2006.01) |
| ***A47B 96/00*** | (2006.01) |
| ***E05D 7/12*** | (2006.01) |
| *A47B 77/00* | (2006.01) |
| *E05D 7/04* | (2006.01) |
| *A47B 87/00* | (2006.01) |
| *A47B 96/06* | (2006.01) |

(52) U.S. Cl.

CPC ..... *A47B 95/008* (2013.01); *A47B 96/00* (2013.01); *E05D 7/123* (2013.01); *A47B 77/00* (2013.01); *A47B 87/008* (2013.01); *A47B 96/067* (2013.01); *E05D 7/0407* (2013.01); *Y10T 29/49828* (2015.01)

(58) Field of Classification Search

CPC ..... A47B 95/008; A47B 95/002; A47B 96/16; A47B 87/007; A47B 87/008; A47B 47/0091

See application file for complete search history.

(56) References Cited

U.S. PATENT DOCUMENTS

| | | | | |
|---|---|---|---|---|
| 2,007,184 A | | 7/1935 | Dunning | |
| 3,698,565 A | | 10/1972 | Weber | |
| 3,950,049 A | * | 4/1976 | Drass | A47B 95/008 312/198 |
| 4,008,872 A | | 2/1977 | Thompson | |

(Continued)

FOREIGN PATENT DOCUMENTS

| | | |
|---|---|---|
| EP | 1262122 A1 | 12/2002 |
| EP | 2275004 A1 | 1/2011 |
| GB | 2444897 A | 6/2008 |

*Primary Examiner* — Daniel Rohrhoff

(74) *Attorney, Agent, or Firm* — Calfee, Halter & Griswold LLP

(57) ABSTRACT

A storage system including an alignment rail mounted to a wall and configured to engage with a first rail mounted on one or more storage members to align the storage members for attachment to a wall and to each other. The storage members may include a second rail and may be mounted to the wall through the first and second rails and attached to each other via fasteners extending through pre-formed apertures in sidewalls of the storage members.

8 Claims, 5 Drawing Sheets

(56) References Cited

U.S. PATENT DOCUMENTS 4,329,003 A * 5/1982 Manchester ..... A47B 95/008 108/152
4,457,436 A * 7/1984 Kelley ..... A47B 95/008 211/88.01
4,711,419 A 12/1987 Polosky
4,928,833 A 5/1990 Huizenga
5,050,832 A 9/1991 Lee et al.
5,135,194 A 8/1992 Laughon et al.
5,222,611 A * 6/1993 Wood ..... A47B 96/06 211/94.01
5,351,929 A 10/1994 Vallance
5,624,168 A 4/1997 Licciardello, Sr.
5,718,493 A * 2/1998 Nikolai ..... A47B 88/0014 312/245
5,819,958 A * 10/1998 Dement ..... A47B 95/008 108/152
5,951,127 A 9/1999 Smith
5,964,438 A * 10/1999 Camilleri ..... A47B 95/008 248/225.21
6,113,201 A 9/2000 Bauer
6,811,043 B2 11/2004 Perkins et al.
7,055,703 B2 6/2006 Perkins et al.
7,083,056 B2 8/2006 Routhier
7,228,977 B2 6/2007 Perkins et al.
7,296,695 B2 11/2007 Perkins et al.
7,992,728 B2 8/2011 Burgess et al.
8,104,850 B2 1/2012 Hager et al.
8,146,754 B2 4/2012 Apgood, II et al.
8,177,311 B2 5/2012 Apgood, II et al.
8,267,363 B2 9/2012 Begic et al.
8,430,252 B2 4/2013 Susan
8,434,835 B2 5/2013 Hardy et al.
8,444,235 B2 5/2013 Gmerek et al.
8,528,871 B2 9/2013 Begic et al.
8,684,195 B1 * 4/2014 Caruso ..... A47B 95/008 211/87.01
2005/0072894 A1 * 4/2005 Grant ..... A47G 1/1606 248/475.1
2006/0091271 A1 5/2006 Nowak
2006/0243688 A1 * 11/2006 Gilcrest ..... A47B 95/008 211/87.01
2008/0224579 A1 * 9/2008 Juten ..... A47F 5/0853 312/111
2009/0152217 A1 * 6/2009 Gmerek ..... A47F 5/0838 211/27
2011/0147551 A1 * 6/2011 Richard ..... A47B 96/067 248/222.14
2012/0018602 A1 * 1/2012 Cattaneo ..... A47B 95/008 248/222.11
2013/0134276 A1 5/2013 Van der Linde et al.
2013/0180202 A1 * 7/2013 Woods ..... A47B 5/00 52/710

* cited by examiner

STORAGE SYSTEM

RELATED APPLICATIONS

This application claims the benefit of U.S. Provisional Patent Application No. 62/009,628, entitled "Storage System", filed on Jun. 9, 2014, hereby incorporated herein in its entirety by reference.

FIELD OF INVENTION

The present invention relates generally to the field of storage systems and more particularly to wall-mounted storage systems configured for installation by a single person.

BACKGROUND

Wall-mounted storage systems, such as kitchen cabinets, are common. For the consumer, it is important that the storage systems not only be functional, but they must also be aesthetically pleasing. Additionally, installing these storage systems can be cumbersome since they often require multiple installers to measure, position, and mount the cabinets to the wall in a manner which ensures that the cabinets are properly aligned. Furthermore, cabinet components such as doors, hinges, and drawer faces, must also be installed and properly aligned. Storage systems that can reduce the amount of steps and the number of installers needed during the installation and alignment process is very desirable.

SUMMARY

The present patent application discloses exemplary embodiments of storage systems. The storage systems may include an alignment rail mounted to a wall and configured to engage with a first rail mounted on one or more storage members to align the storage members for attachment to a wall and to each other. The storage members may include a second rail and may be mounted to the wall through the first and second rails and attached to each other via fasteners extending through pre-formed apertures in sidewalls of the storage members.

Some exemplary embodiments of the storage members may include snap-in adjustable hinge assemblies, extendable feet, and a locking and adjustment mechanism for detachably mounting and adjusting a drawer face to a drawer.

BRIEF DESCRIPTION OF THE SEVERAL VIEWS OF THE DRAWINGS

The accompanying drawings, which are incorporated in and constitute a part of this specification, illustrate some embodiments disclosed herein, and together with the description, serve to explain principles of the embodiments disclosed herein.

DETAILED DESCRIPTION

The embodiments disclosed herein will now be described by reference to some more detailed embodiments, in view of the accompanying drawings. These embodiments may, however, be embodied in different forms and should not be construed as limited to the embodiments set forth herein. Rather, these embodiments are provided so that this disclosure will be thorough and complete, and will fully convey the scope of the inventions to those skilled in the art.

Unless otherwise defined, all technical and scientific terms used herein have the same meaning as commonly understood by one of ordinary skill in the art to which these embodiments belong. The terminology used in the description herein is for describing particular embodiments only and is not intended to be limiting of the embodiments. As used in the specification and the appended claims, the singular forms "a," "an," and "the" are intended to include the plural forms as well, unless the context clearly indicates otherwise. All publications, patent applications, patents, and other references mentioned herein are incorporated by reference in their entirety.

Notwithstanding that the numerical ranges and parameters setting forth the broad scope of the embodiments are approximations, the numerical values set forth in the specific examples are reported as precisely as possible. Any numerical value, however, inherently contains certain errors necessarily resulting from the standard deviation found in their respective testing measurements. Every numerical range given throughout this specification and claims will include every narrower numerical range that falls within such broader numerical range, as if such narrower numerical ranges were all expressly written herein.

Figure 1:
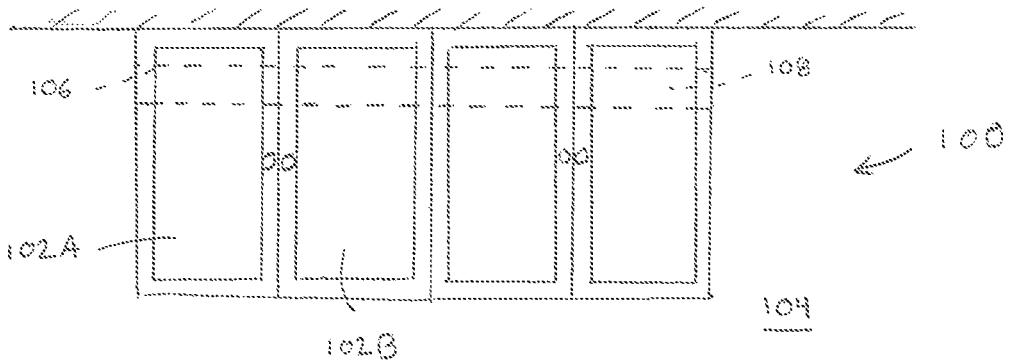
FIG. 1 shows a front view of an exemplary embodiment of a wall-mounted storage system.
Figure 1:
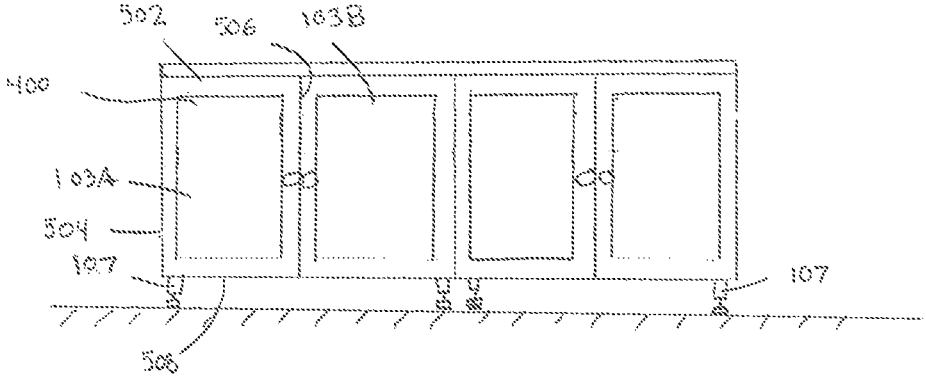
Figure 3:
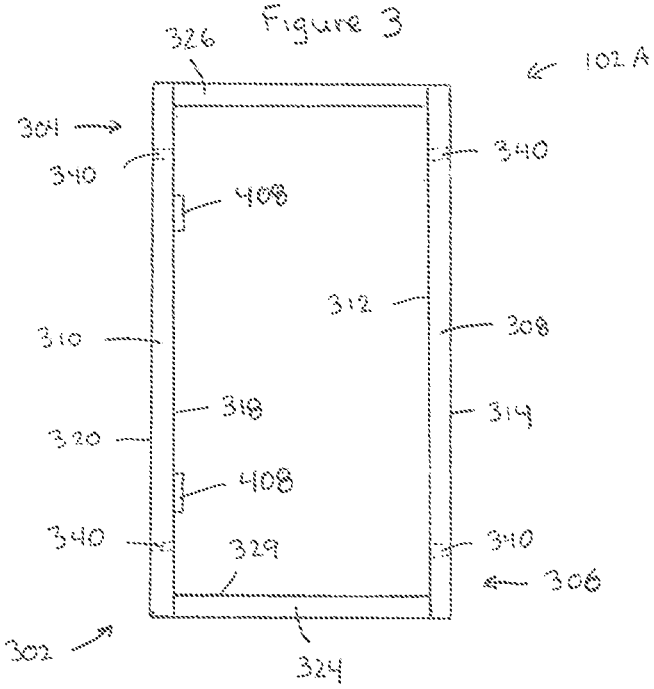
FIG. 3 shows a front view of an exemplary embodiment of a storage member of the storage system of FIG. 1.
Figure 4:
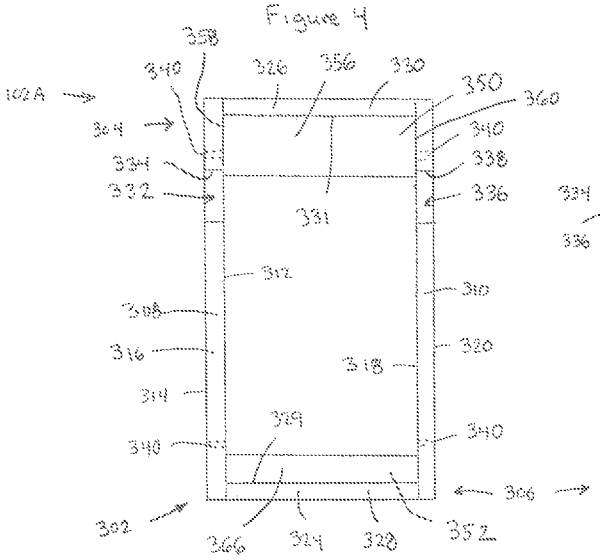
FIG. 4 shows a rear view of the storage member of FIG. 3.

Referring to FIG. 1, the present application discloses a storage system 100 that includes at least one storage member 102 configured to be mounted to a wall 104 and aligned using an alignment rail 106. The storage system 100 may also include one or more storage members 103 configured to be mounted to a wall 104 and aligned using a plurality of adjustable feet 107. In the illustrated exemplary embodiment, the storage system 100 includes a first storage member 102A, a second storage member 102B, a third storage member 103A, a fourth storage member 103B, the alignment rail 106 that mounts to the wall 104, and the plurality of adjustable feet 107. The alignment rail 106 may be configured in a variety of ways. Any structure that can be mounted to the wall in such a way as to align the height of two or more cabinets on the wall may be used.

Figure 2:
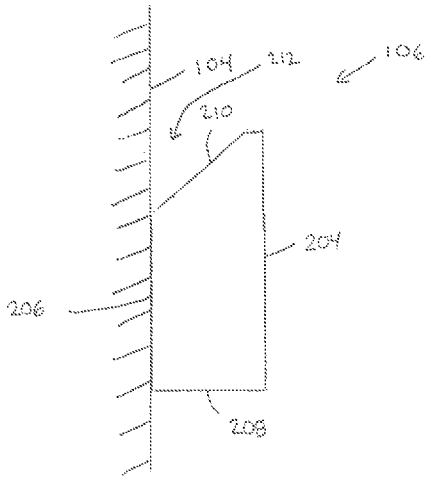
FIG. 2 shows a side view of an exemplary embodiment of an alignment rail of the storage system of FIG. 1.

In the exemplary embodiment illustrated in FIGS. 1 and 2, the alignment rail 106 has an elongated rail body 108 configured to extend horizontally across at least a portion of the wall 104 such that at least one, and preferably multiple, storage members 102 may be aligned by the rail 106. The rail body 108 includes a front face 204, a back face 206 that is generally parallel to the front face and configured to abut the wall 104, a lower surface 208 positioned between the front face and the back face, and an upper surface 210 positioned between the front face and the rear face. In the exemplary embodiment, the upper surface 210 is inclined from the back face 206 to the front face 204 which creates a channel 212 when the alignment rail 106 is mounted on the wall 104. In another exemplary embodiment, the lower surface 208 is also inclined from the back face 206 to the front face 204 similar to the incline of the upper surface 210 so that the alignment rail 106 can be rotated 180 degrees and still present an upper inclined surface. In yet another embodiment, the upper surface 210 may be other than inclined and still form a channel when the alignment rail is mounted on the wall. For example, the upper surface may be a curved concave surface or form a step. The alignment rail 106 may be made of any suitable material, such as wood or plastic.

FIGS. 3-6 illustrate an exemplary embodiment of the first storage member 102A. The second storage member 102B is substantially similar to the first storage member 102A and thus, the description of the first storage member 102A also applies to the second storage member. The first storage member 102A may be configured in a variety of ways, such as various shapes and sizes. In the exemplary embodiment, the first storage member 102 includes a rectangular frame 302 having an upper portion 304, a lower portion 306 opposite the upper portion, a first sidewall 308, and a second sidewall 310. The first sidewall 308 includes an inner side surface 312, an outer side surface 314 that is generally parallel to the inner side surface, and a rear edge 316. Similarly, the second sidewall 310 includes an inner side surface 318, an outer side surface 320 that is generally parallel to the inner side surface 318, and a rear edge 322.

The rectangular frame 302 also includes a bottom wall 324 and a top wall 326. The bottom wall 324 extends between the inner side surface 312 of the first sidewall 308 and the inner side surface 318 of the second sidewall 310 along the lower portion 306 of the frame 302 and includes a rear edge 328 and an inner side surface 329. The top wall 326 extends between the inner side surface 312 of the first sidewall 308 and the inner side surface 318 of the second sidewall 310 along the upper portion 304 of the frame 302 and includes a rear edge 330 and an inner side surface 331.

Figure 5:
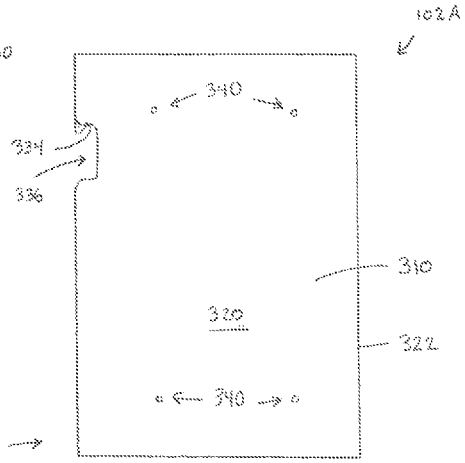
FIG. 5 is a side view of the storage member of FIG. 3.

Referring to FIG. 5, the rear edge 316 of the first sidewall 308 includes a recess or notch 332 having an upper surface 334. The rear edge 322 of the second side wall 310 includes a similar recess or notch 336 having an upper surface 338 and being positioned substantially in the same position on the second sidewall 310 as the recess 332 is position on the first sidewall 308. The first recess 332 and the second recess 336 are configured to receive the alignment rail 106. In the illustrated exemplary embodiment, the upper surface 334 and the upper surface 338 are substantially perpendicular to the rear edge 316 and the rear edge 322, respectively. In other embodiments, however, the upper surfaces 334, 338 may extend at an angle. For example, the upper surfaces 334, 338 may be inclined at an angle complementary to the inclined upper surface 210 on the alignment rail 106.

One or more fastener receiving apertures 340 may be formed through the first sidewall 308 or the second sidewall 310 or both. In the exemplary embodiment, two horizontally spaced-apart apertures 340 extend through the first sidewall 308 in the upper portion 304 of the frame 302 and two horizontally spaced-apart apertures 340 extend through the first sidewall in the lower portion 306 of the frame. The one or more apertures 340 may be pre-formed in the first sidewall 308 and/or the second sidewall 310 during manufacturing of the first storage member 102A prior to sale or installation.

Figure 6:
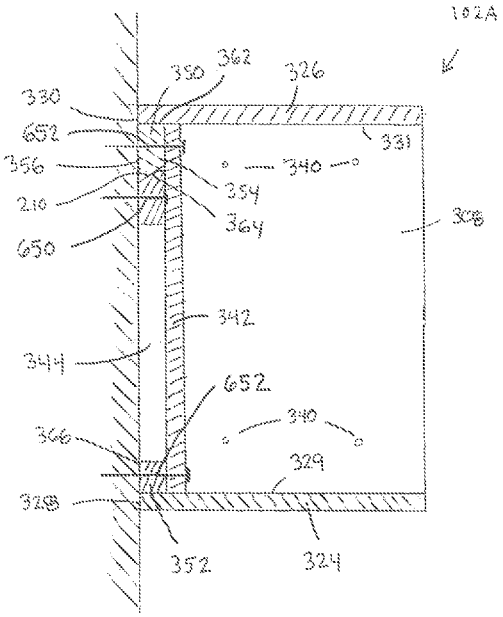
FIG. 6 is a side section view of the storage member of FIG. 3.

Referring to FIG. 6, the first storage member 102A includes a rear wall 342 that extends horizontally between the first sidewall 308 and the second sidewall 310 and vertically between the bottom wall 324 and the top wall 326. The rear wall 342 is positioned inward from the rear edges 316, 322, 328, 330 of the first sidewall 308, the second sidewall 310, the bottom wall 324, and the top wall 326, respectively, to form a rear lip 344.

The first storage member 102A includes a first rail 350 and a second rail 352. The first rail 350 and the second rail 352 may be configured in a variety of ways, such as, for example varying in shape, size, and material. Any structure capable of facilitating mounting the first storage member to the wall while, with respect to the first rail, cooperating with the alignment rail to align the height of the storage member on the wall, may be used. In the exemplary embodiment of FIGS. 4 and 6, the first rail 350 has a substantially planar front face 354, a substantially planar rear face 356 that is substantially parallel to the front face, a first side surface 358, a second side surface 360 that is substantially parallel to the first side surface, a top surface 362 between the front face 354 and the rear face 356, and a bottom surface 364 between the front face 354 and the rear face 356 opposite the top surface. The bottom surface 364 is inclined from the front face 354 to the rear face 356 at an angle complementary to the angle of incline of the upper surface 210 of the alignment rail 106.

The first rail 350 is mounted to the upper portion 304 of the frame 302 between the first sidewall 308 and the second sidewall 310 such that it nests within the rear lip 344. In particular, in the exemplary embodiment, the first side surface 358 of the first rail 350 abuts the inner side surface 312 of the first sidewall 308, the second side surface 360 abuts the inner side surface 318 of the second sidewall 310, and the top surface 362 abuts the inner side surface 331 of the top wall 326. The thickness of the first rail 350 is such that when mounted to the frame 302, the rear face 356 of the first rail 350 is substantially flush with the rear edges 316, 322, 330 of the first sidewall 308, the second sidewall 310, and the top wall 326, respectively.

Similarly, the second rail 352 is mounted to the lower portion 306 of the frame 302 between the first sidewall 308 and the second sidewall 310 such that it nests within the rear lip 344. The second rail 352 includes a rear face 366 that when mounted to the frame 302 is substantially flush with the rear edges 316, 322, 328 of the first sidewall 308, the second sidewall 310, and the bottom wall 324, respectively.

Referring to FIGS. 1, 3, and 7-10, the first storage member 102A may also include a door 400 pivotably mounted to the frame 302 by one or more separable and adjustable door hinge assemblies 402. The door hinge assemblies 402 may be configured in a variety of ways. Any assembly capable of being separable such that the door 400 may be easily pivotably attached and detached from the frame 302 may be used. In the illustrated exemplary embodiment, the hinge assembly 402 (FIGS. 10A-10C) includes a hinge cup segment 404, a hinge arm segment 406 and a hinge base segment 408. The hinge cup segment 404 is configured to be fixably mounted to the inner side of the door 400 by one or more fasteners 410. The hinge cup segment 404 includes a recess 412 configured to receive a portion of the hinge arm segment 406.

The hinge arm segment 406 has a first end portion 414 that is pivotably mounted to the hinge cup segment 404 and a second end portion 416 that is configured to be releasably attached to the hinge base segment 408. The second end portion 416 includes a pair of hooks 420, a pair of projections 422, a spring-biased, movable latch 424, and a latch interface 426. The latch 424 is movable between a latched position and an unlatched position and is biased to the latched position. The latch interface 426 is configured to be engaged by a user to move the latch 424 to the unlatch position.

Figure 9:
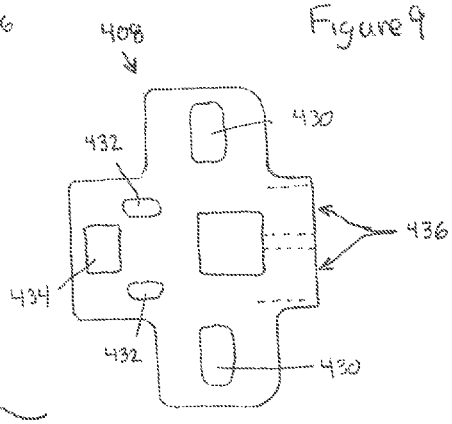
FIG. 9 is a top view of an exemplary embodiment of a hinge base segment of the hinge assembly of FIG. 8.

The hinge base segment 408 is configured to be mounted to the inner side surface 318 of the second side wall 310 via one or more fasteners 428. As shown in FIG. 9, the hinge base segment 408 includes a pair of noncircular fastener openings 430 configured to receive the one or more fasteners 428, a pair of apertures 432 configured to receive the projections 422 of the hinge arm segment 406, a latch aperture 434 configured to receive the latch 424 of the hinge arm segment, and a pair of channels 436 configured to receive the hooks 420.

Figure 10A:
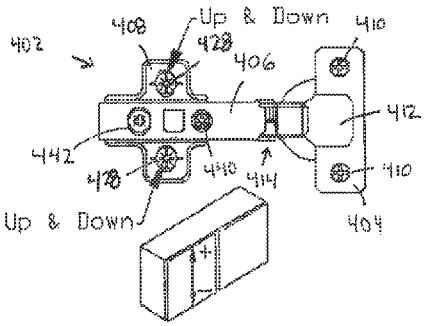
FIG. 10A is a top view of the hinge assembly of FIG. 8 illustrating the up and down adjustability of the hinge assembly.
Figure 10B:
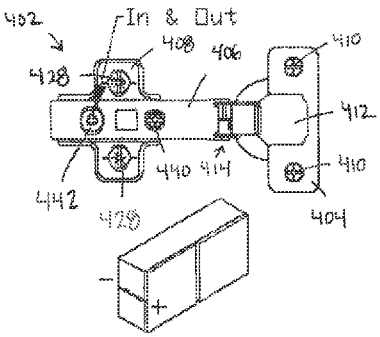
FIG. 10B is a top view of the hinge assembly of FIG. 8 illustrating the in and out adjustability of the hinge assembly.
Figure 10C:
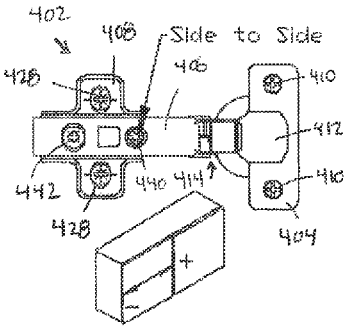
FIG. 10C is a top view of the hinge assembly of FIG. 8 illustrating the side to side adjustability of the hinge assembly.

The hinge assembly 402 is also adjustable such that it can adjust the position of the door 400 relative to the frame 302. As shown in FIGS. 10A-10C, the noncircular shape of the fastener openings 430 allow up and down adjustment of the location of the hinge base segment 408 relative to the frame 302. In addition, the hinge assembly 402 includes a horizontal adjustment screw 440 to adjust the side-to-side position of the door 400 relative to the frame 302 and a depth adjustment screw 442 to adjust the in-and-out position door relative to the frame.

As shown in FIG. 1, one or more storage members in the storage system 100 may include the adjustable feet 107. In the illustrated embodiment, the first and second storage members 102A, 102B are mounted to the wall 104 with their mounting height aligned by the alignment rail 106. The third and fourth storage members 103A, 103B, however, are mounted to the wall 104 with their mounting height aligned by a plurality of the adjustable feet 107. The third and fourth storage members 103, 103B can be substantially similar to the first and second storage members 102A, 102B in that the third and fourth storage members include a rectangular frame 502 having a first sidewall 504, a second sidewall 506, and a bottom wall 508. In the exemplary embodiment, the third and fourth storage members 103A, 103B, each include four adjustable feet 107 attached to and extending downward from the bottom wall 508 in each of the corners of the third and fourth storage member 103A.

Figure 11:
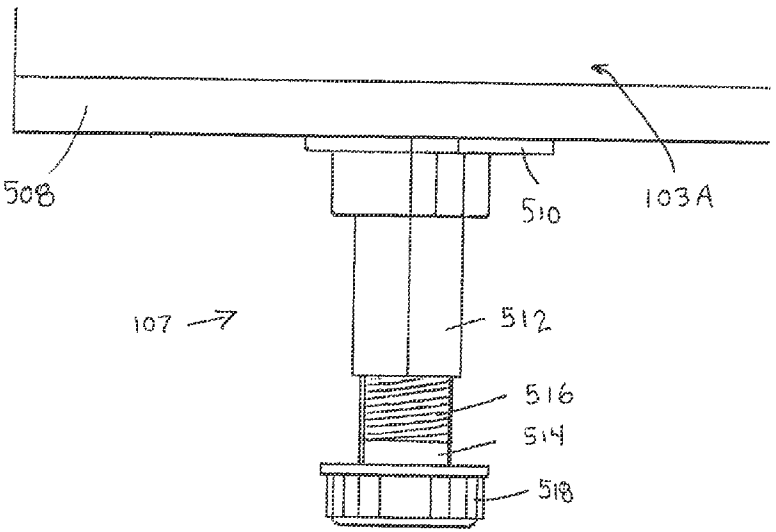
FIG. 11 is a side view of an exemplary embodiment of an adjustable foot of the storage system of FIG. 1.
Figure 7:
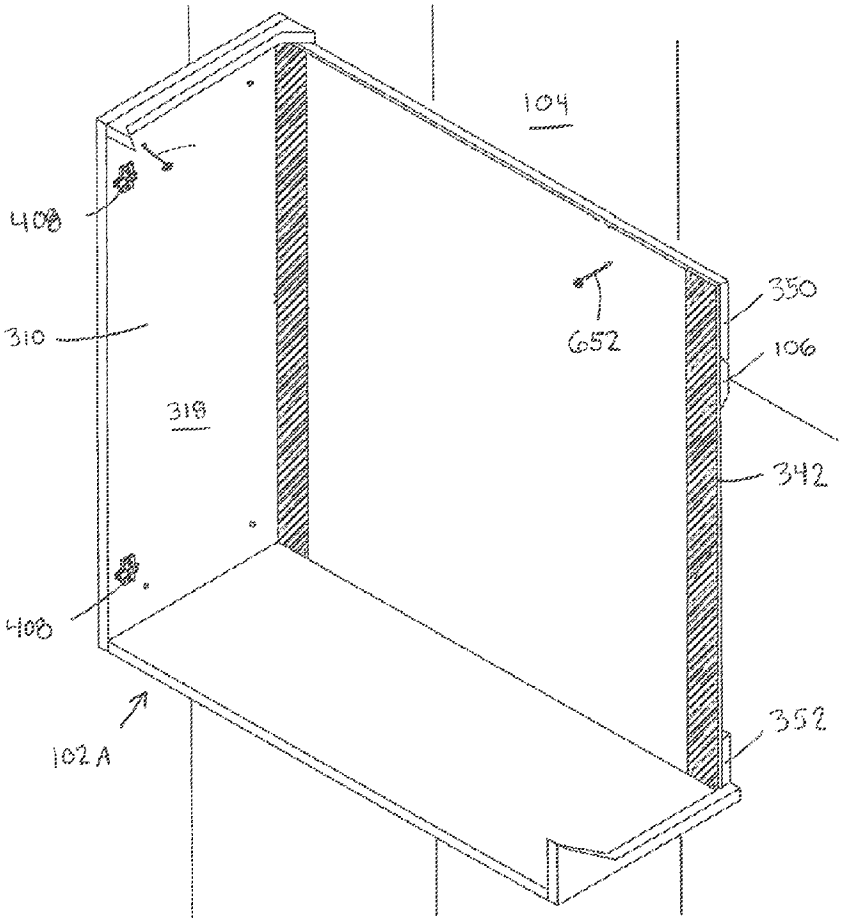
FIG. 7 is a partial perspective view of the storage member of FIG. 3.
Figure 8:
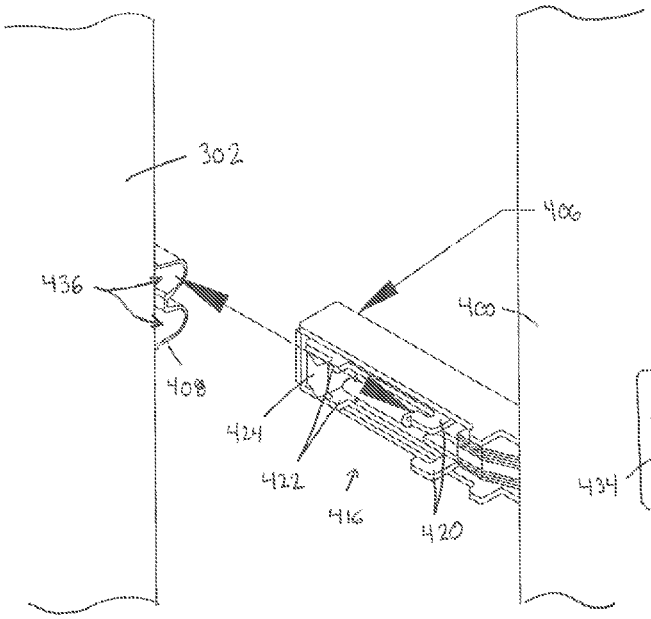
FIG. 8 is a partial perspective view of an exemplary embodiment of a hinge assembly of the storage system of FIG. 1.

Referring to FIG. 11, the adjustable foot 107 includes a mounting flange 510, a hollow stem 512 having internal female threads (not shown), and a shaft 514 having external male threads 516 for mating with the threads in the stem. The shaft 514 is extendable/retractable by rotating the shaft relative to the stem 512. A foot portion 518 is attached to the distal end of the shaft 514 for engaging the ground. The adjustable foot 107 can be mounted to the bottom wall 508 in any suitable manner, such as for example, by one or more fasteners extending through the mounting flange 510.

Figure 12:
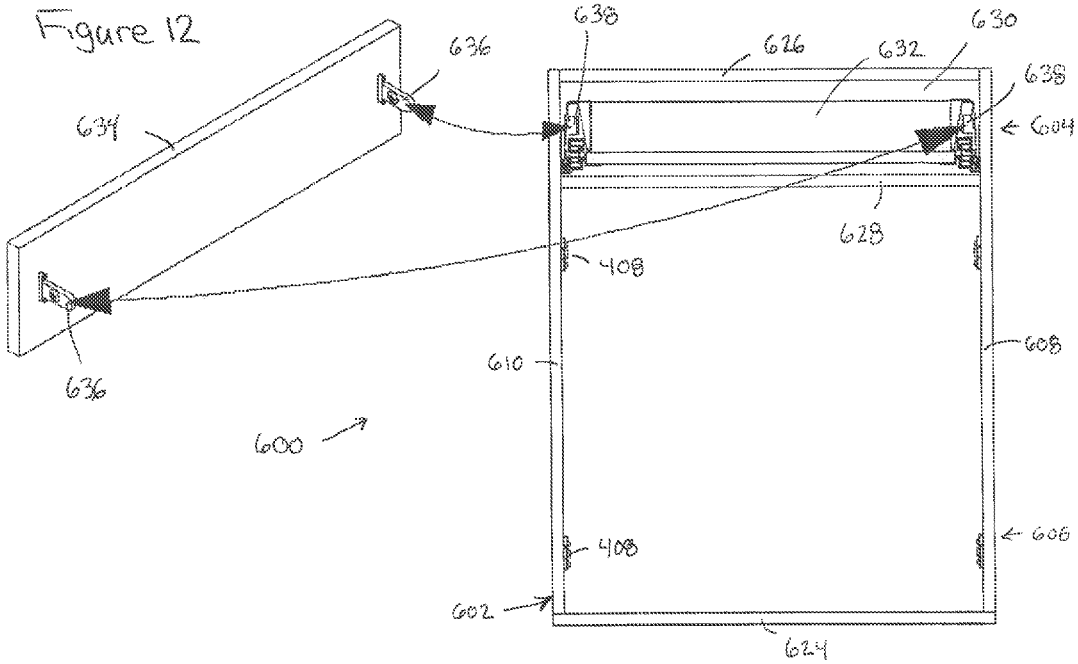
FIG. 12 is a front view of another exemplary embodiment of a storage member of the storage system of FIG. 1 with a perspective view of a drawer face.
Figure 13:
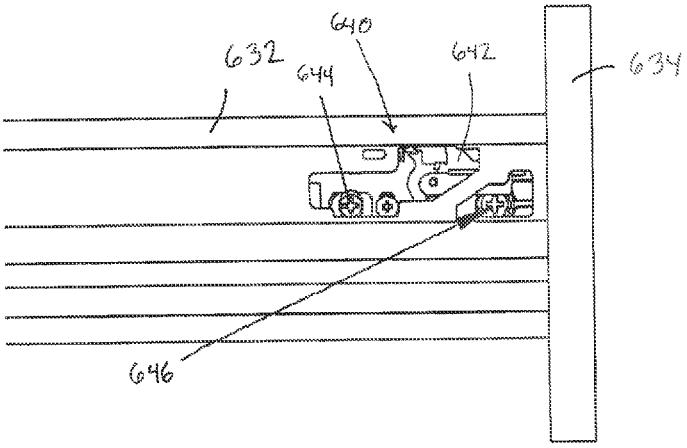
FIG. 13 is a partial side view of a drawer of the storage member of FIG. 12.

FIG. 12 illustrates an exemplary embodiment of a storage member 600 similar to the first storage member 102A in that the storage member 600 includes a rectangular frame 602 having an upper portion 604, a lower portion 606 opposite the upper portion, a first sidewall 608, a second side wall 610, a bottom wall 624, and a top wall 626. The storage member 600, however, also includes an intermediate horizontal wall 628 substantially parallel to the top wall 626 in the upper portion 604 to form a drawer compartment 630. The drawer compartment 630 includes a drawer 632 slideably received in the drawer compartment 630. The drawer 632 includes a detachable drawer face 634. The drawer face 634 includes one or more projections 636 configured to be received in openings 638 in the drawer for attaching the drawer face to the drawer. A locking and adjustment mechanism 640 is integrated in the drawer 632. The locking and adjustment mechanism 640 may be configured in a variety of ways. Any mechanism that allows for attaching the drawer face to the drawer without the need for external fasteners and also permits vertical and horizontal adjustment of the drawer face with respect to the drawer may be used. In the illustrated embodiment, the locking and adjustment mechanism 640 includes a cam lock 642 that engages the projections 636 to hold the drawer face 634 to the drawer 632, a vertical adjustment screw 644 that moves the drawer face 634 vertically relative to the drawer, and a horizontal adjustment screw 646 that moves the drawer face horizontally relative to the drawer.

In the past, installation of a storage system with multiple storage members, such as for example, a kitchen cabinet system, may require multiple installers to position, align, and mount the cabinets to the wall. In addition, installing cabinet component such as doors, hinges, and drawer faces required significant efforts to properly measure, align, and attach such components. The storage system 100 is configured such that a single person can install the storage system with little difficulty and in less time than traditional systems.

To install the storage system 100, the alignment rail 106 is mounted onto the wall 104 such that it extends horizontally along the wall and the upper inclined surface 210 is facing upward. A level (not shown) may be used to ensure the rail 106 is level. The alignment rail 106 may extend along the wall 104 a sufficient length such that the desired number of storage members 102 may be aligned by the alignment rail. The length of the alignment rail 106 may be customized as needed to accommodate the desired number of storage members. While preferably a single piece, the alignment rail 106 may include multiple rails mounted end-to-end along the wall 104 should additional length be needed. The alignment rail 106 may be mounted to the wall 104 in any suitable manner. For example, the alignment rail 106 may be mounted by fasteners 650 (FIG. 6), such as nails or screws, or may be mounted by adhesives or other suitable means.

The storage members 102 can be sold with the first rail 350, the second rail 352, and the hinge base portions 408 already attached and the fastener receiving apertures 340 already formed in the sidewalls. Therefore, once the alignment rail 106 has been mounted to the wall 104, the first storage member 102A can be placed onto the rail such that the alignment rail is received in both the first recess 332 and the second recess 336 and the inclined upper surface 210 of the alignment rail engages the inclined bottom surface 364 of the first rail 350. In this position, a portion of the first rail 350 is received in the channel 212. The first storage member 102A can then be attached to the wall 104 via one or more fasteners 652 (FIGS. 6 and 7) extending through the first rail 350 and the second rail 352. In this position, the first storage member 102A and is flush against the wall 104. In particular, the rear edges 316, 322, 328, 330 of the first sidewall 308, the second sidewall 310, the bottom wall 324, and the top wall 326, respectively, and the rear face 356 of the first rail 350 and the rear face 366 of the second rail 352 abut the wall.

The second storage member 102B may be mounted on the wall in the same manner adjacent the first storage member 102A such that the second sidewall 320 of the first storage member 102A is adjacent the first side wall of the second storage member 102B. Since, the alignment rail 106 has aligned the mounted height of both the first and second storage members 102A, 102B, the one or more fastener receiving apertures 340 in the sidewalls of both storage members will be aligned, thus facilitating the ability to pre-form or pre-drill the apertures prior to installation. Fasteners 654 (FIG. 7) can be received through the aligned apertures 340 in the adjacent sidewalls to connect the first storage member 102A to the second storage member 102B. Additional storage members may be installed side-by-side in a similar manner.

The door 400 may also be sold with the one or more hinge cup segments 404 and hinge arm segments 406 already installed. Thus, to attached the door 400 to the frame 302, the second end portion 416 of the hinge arm segment 406 is placed onto the hinge base segment 408 such that the pair of hooks 420 are received in the pair of channels 436, the pair of projections 422 are received in the a pair of apertures 432, and the movable latch 424 is received in the latch aperture 434. The bias of the latch 424 to the latched position allows it to snap or clip into place and firmly, but releasably, attach the hinge arm segment 406 to the hinge base segment 408. In this manner, the door 400 is pivotably mounted to the frame 302 and its position relative to the frame can be adjusted via the fasteners in the fastener openings 430, the horizontal adjustment screw 440, and the depth adjustment screw 442.

If the storage member is configured with a drawer 632, such as the storage member 600 in FIG. 12, the storage member can be sold with the drawer 632 already installed or simply needing to be slid into the drawer compartment 630. The drawer face 634 can be installed onto the drawer 632 by placing the drawer face against the drawer such that the apertures 638 receive the projections 636 on the drawer face. The drawer face 634 can then be secured to the drawer by turning the cam lock 642 which locks the drawer face in place. The drawer face 634 position, relative to the drawer 632, can be adjusted via the vertical adjustment screw 644 and the horizontal adjustment screw 646.

Thus, the door 400, the drawer 632, and the drawer face 634 are all easily installable onto the storage members 102, 103 after the storage members have been mounted onto a wall. For example, the frame 302 of the first storage member 102A may be mounted to the wall 402 without the door 400 attached. This makes handling of the first storage member 102A easier during installation since the frame 302 is lighter without the door 400 and also eliminates the chance of the door swinging open or closed while being installed. Once the frame 302 has been mounted, the door 400 can be easily attached by snapping or clipping the hinge arm segment 406 to the hinge base segment 408.

If the storage member is configured with adjustable feet 107, such as the storage member 103A in FIG. 1, the storage member can be sold with adjustable feet already attached. The height of the storage member can be aligned by rotating the shaft 514 relative to the stem 512 to extend or retract the foot portion 518. A second storage member can positioned adjacent the first storage member and aligned similarly. As with the first and second storage member 102A, 102B, since the height of the storage members are easily aligned, the storage members can be sold with pre-formed or pre-drilled fastener receiving apertures in the sidewalls to facilitate side-to-side attachment.

The above description of specific embodiments has been given by way of example. From the disclosure given, those skilled in the art will not only understand the general inventive concepts and attendant advantages, but will also find apparent various changes and modifications to the structures and methods disclosed. For example, the general inventive concepts are not typically limited to any particular storage system. Thus, for example, use of the inventive concepts in both residential and commercial applications, are within the spirit and scope of the general inventive concepts. It is sought, therefore, to cover all such changes and modifications as fall within the spirit and scope of the general inventive concepts, as described and claimed herein, and equivalents thereof.

We claim:

1. A wall-mounted storage system, comprising:

an elongated alignment rail horizontally mounted to a wall, the alignment rail having a front face, a back face generally parallel to the front face and abutting the wall, and an upper inclined surface between the front face and the back face;

a storage member having a rectangular frame including an upper portion, a lower portion, a first sidewall and a second sidewall;

a first rail mounted between the first sidewall and the second sidewall in the upper portion, the first rail having a rear face that engages the wall and a lower inclined surface that mates with the upper inclined surface of the alignment rail;

a second rail mounted between the first sidewall and the second sidewall in the lower portion, the second rail having a rear face that engages the wall;

a pre-formed alignment hole in the first sidewall configured to align with a corresponding pre-formed alignment hole in an adjacent storage member for side-to-side alignment and connection; and one or more fasteners extending through the first rail and into the wall and one or more fasteners extending through the second rail and into the wall to mount the storage member to the wall.

2. The wall-mounted storage system of claim 1 further comprising a door member and a hinge assembly having a first portion that mounts to the door and a second portion that mounts to the frame, wherein the first portion releasably snaps into the second portion such that the door is pivotally mounted to the frame.

3. The wall-mounted storage system of claim 2 further comprising a drawer, a drawer face, and a locking and adjustment assembly integrated in the drawer, wherein the locking and adjustment assembly releasably attaches the drawer face to the drawer and adjusts the position of the drawer face relative to the drawer.

4. The wall-mounted storage system of claim 3 wherein the storage member further comprises a top wall extending between the first sidewall and the second sidewall, and the top wall, the first sidewall and the second sidewall have rear edges, and wherein the rear face of the first rail is substantially parallel with the rear edges.

5. The wall-mounted storage system of claim 4 wherein the rear edge of the first side wall and the rear edge of the second side wall each include a recess that receives the alignment rail such that the rear edge of the first side wall and the rear edge of the second side wall engages the wall.

6. The wall-mounted storage system of claim 1 further comprising a second storage member positioned adjacent the first storage member, the second storage member including:

rectangular frame having a third sidewall and a fourth sidewall;

a third rail mounted between the third sidewall and the fourth sidewall, the third rail having a rear face that engages the wall and a lower inclined surface that mates with the upper inclined surface of the aligning rail;

a fourth rail mounted between the third sidewall and the fourth sidewall, the fourth rail having a rear face that engages the wall;

a second pre-formed alignment hole in the third sidewall that is aligned with the pre-formed alignment hole in the first sidewall in the first storage member, and a fastener extending through the pre-formed alignment hole in the first sidewall and the second preformed alignment hole in the third sidewall to connect the first and second storage members.

7. The wall-mounted storage system of claim 6 wherein the third sidewall has a rear edge and the fourth sidewall has a rear edge, wherein each of the rear edges of the third sidewall and the fourth sidewall includes a recess that receives the alignment rail such that the rear edge of the third side wall and the rear edge of the fourth side wall engages the wall.

8. The wall-mounted storage system of claim 1 wherein the storage member is not attached to the alignment rail by fasteners.

* * * * *